US005667238A

United States Patent [19]

Sarver

[11] Patent Number: 5,667,238

[45] Date of Patent: *Sep. 16, 1997

[54] SKI HAVING COMPOUND CURVE UNDERSURFACE

[76] Inventor: John J. Sarver, 2827 Tabago Pl., Costa Mesa, Calif. 92626

[ * ] Notice: The term of this patent shall not extend beyond the expiration date of Pat. No. 5,375,868.

[21] Appl. No.: 364,662

[22] Filed: Dec. 27, 1994

Related U.S. Application Data

[63] Continuation-in-part of Ser. No. 25,578, Mar. 3, 1993, Pat. No. 5,375,868.

[51] Int. Cl.[6] ..... A63C 5/04

[52] U.S. Cl. ..... 280/609

[58] Field of Search ..... 280/600, 601, 280/602, 604, 607, 608, 609, 809

[56] References Cited

U.S. PATENT DOCUMENTS

| | | | |
|---|---|---|---|
| 4,974,868 | 12/1990 | Morris | 280/609 |
| 5,375,868 | 12/1994 | Sarver | 280/609 |

FOREIGN PATENT DOCUMENTS

| | | | |
|---|---|---|---|
| 285338 | 6/1915 | Germany | 280/609 |
| 2013061 | 9/1971 | Germany | 280/609 |
| 144867 | 11/1980 | Germany | 280/604 |
| 84/04693 | 12/1984 | WIPO | 280/609 |

*Primary Examiner*—Richard M. Camby
*Assistant Examiner*—Frank Vanaman
*Attorney, Agent, or Firm*—Oblon, Spivak, McClelland, Maier & Neustadt, P.C.

[57] ABSTRACT

A ski or snowboard defines a compound curve undersurface having a concave camber portion and a reverse camber convex portion. The ski or snowboard includes an upwardly curved tail portion and an upwardly curved front shovel portion. The transition between the concave camber portion and the reverse camber frontal portion defines a front contact point while the transition between the concave camber portion and the upwardly curved tail portion forms a rear contact point. A ski boot is secured to the upper surface of the ski in accordance with conventional fabrication techniques and is positioned overlying the concave camber portion.

11 Claims, 5 Drawing Sheets

SKI HAVING COMPOUND CURVE UNDERSURFACE

The present application is a continuation-in-part of U.S. application Ser. No. 08/025,578 filed Mar. 3, 1993, now, U.S. Pat. No. 5,375,868.

SPECIFICATION

1. Field of the Invention

This invention relates generally to snow skiing and particularly to ski structures used therein.

2. Background of the Invention

The sport of snow skiing has, for many years, been extremely popular with a wide variety of participants. Despite this popularity, however, skiing remains a relatively difficult sport to learn and master. Many methods have been utilized in attempting to overcome this obstacle. Nonetheless, the challenge of learning to ski confidently in order to fulfill the anticipated enjoyment of the sport of skiing remains a substantial obstacle for novice skiers. One of the most pervasive methods of teaching novice skiers the art of skiing is referred to as the graduated length method in which skiers initially utilize a relatively short ski typically of ninety centimeters in length during initial ski instruction sessions and thereafter graduate through several increasing ski lengths until the ultimate goal of conventional length skis and effective use thereof has been achieved. In a more modern and more recently emerging style of instruction, the student is started out with skis of conventional length which typically equal or exceed one hundred sixty centimeters. In this teaching method, the instruction encourages the student to employ independent leg action. As a result, the student generally undertakes what is called a wedge turn in which the skier often finds that despite the instruction to turn on the forward portion of the ski in what is called a weight forward condition, it is easier to conclude the turn with the skier's weight exerted on the rear portion or tails of the skis. This tendency to shift the weight to the tail portion of the skis to affect a turn must be "unlearned" and overcome if the student is to progress to more advanced skiing levels of the optimum weight forward techniques. When one finally jumps up to advanced forward skiing technique, speed is required to reverse camber the forward portion of the ski in order for it to arc and turn toward the intended direction of turn. Because of the speed required to do this, beginner skiers are at an almost insurmountable disadvantage and subsequently cannot learn this method. Throughout the entire ski instruction process, the novice is constantly subjected to repeated falls which in turn undermines the skier's confidence and inhibits the learning process.

To meet the varying need of skiers at different skill levels, practitioners in the art have provided a great variety of skis having different lengths and different curvature profiles. For example, U.S. Pat. No. 4,007,946 issued to Sarver sets forth a SHORT SKI in which a pair of short skis each comprise a flexible forward shovel section and a less flexible after section. The flexible shovel section includes a substantially flat running portion and a leading tip portion which is curved upwardly. The total running length of the ski formed by the running portion and the less flexible section is substantially shorter than more conventional skis. These shorter skis are intended for use by skiers employing the skiing technique wherein turning of the skis is accomplished with the skier's weight at all times disposed no farther forward than the median of the running length of the skis.

U.S. Pat. No. 4,085,947 issued to Sarver sets forth REARWARDLY CONTROLLED SNOW SKIIS in which each ski comprises a relatively rigid weight bearing rear portion for mounting of ski boots thereon and a rearwardly projecting trailing portion terminating in a trailing edge. The skis also extend forwardly from the boot and define inwardly tapering top and bottom surfaces to form a relatively flexible planing portion. Then skis also taper outwardly along their opposite edges to form a relatively wide upturn shovel at the front extremity thereof.

U.S. Pat. No. 3,212,787 issued to Werntz sets forth a SNOW SKI FOR MAKING FAST TURNS in which the ski defines a relatively thick center portion above which a skier's boot is supported and a forwardly extending thinner more flexible portion having a plurality of upwardly angled facets and terminating in a pointed shovel portion. The angle between the running surface and the facets increases as the facets approach the upwardly turned shovel portion. The tail portion of the ski also tapers with the distance from the skier's boot.

U.S. Pat. No. 4,343,485 issued to Johnston, et al. sets forth a REVERSE CAMBER SKI in which the bottom surface of the ski is curved upwardly in either direction from the location of the skier's boot and in which a curved shovel portion and curved tail portion are formed at the front and rear of the ski. The side camber configuration of the ski defines an hour glass shape being thinner at the region of the skier's boot and larger at the tail and shovel sections.

U.S. Pat. No. 4,509,771 issued to Nussbaumer sets forth a SKI in which an Alpine ski defines a front portion adjoining its tip, a rear portion, and an intervening middle portion supporting a binding. The three portions differ from one another in their profiling and are designed to exert a minimum guiding effect in the middle portion and a maximum guiding effect in the rear portion. The rear portion defines one or more longitudinal grooves whose combined cross-sectional area exceeds that of the groove or grooves in the front portion. The middle portion is grooved slightly or is free of grooves.

U.S. Pat. No. 4,705,291 issued to Gauer sets forth an ALPINE SKI in which a relatively rigid ski is formed to define a generally planar upper surface supporting a ski boot and a convex front to rear curved undersurface. The ski has a maximum effective width substantially in-line with the pivot point over which the skier's weight is to be centered. The ski assumes a narrower effective width both forward and rearward of the pivot point and an intermediate effective width closer to the front and rear respectively.

While the foregoing described prior art skis represent various attempts to provide effective skis, there remains nonetheless a continuing need in the art for evermore improved skis which may be utilized by skiers in mastering the techniques of effective skiing.

SUMMARY OF THE INVENTION

Accordingly, it is a general object of the present invention to provide an improved ski, snowboard and mono-ski. It is a more particular object of the present invention to provide a relatively short ski which is advantageous in teaching novice skiers the art of skiing and which is exciting for advanced more skilled skiers to utilize. It is a still more particular object of the present invention to provide an improved ski which encourages the user to employ a weight forward skiing technique in initiating a turn. It is a further object of the present invention to provide an improved snowboard and mono-ski structure which achieves the benefits of the present invention.

In accordance with the present invention, there is provided for use in snow skiing upon a snow covered surface, a ski comprises: an elongated ski body defining a front shovel, a rear tail, an upper surface and a lower surface; and binding means for securing a ski boot to the upper surface, the ski body defining a concave camber portion extending forwardly from the rear tail and a reverse camber convex portion extending forwardly from the concave camber portion to the front shovel.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
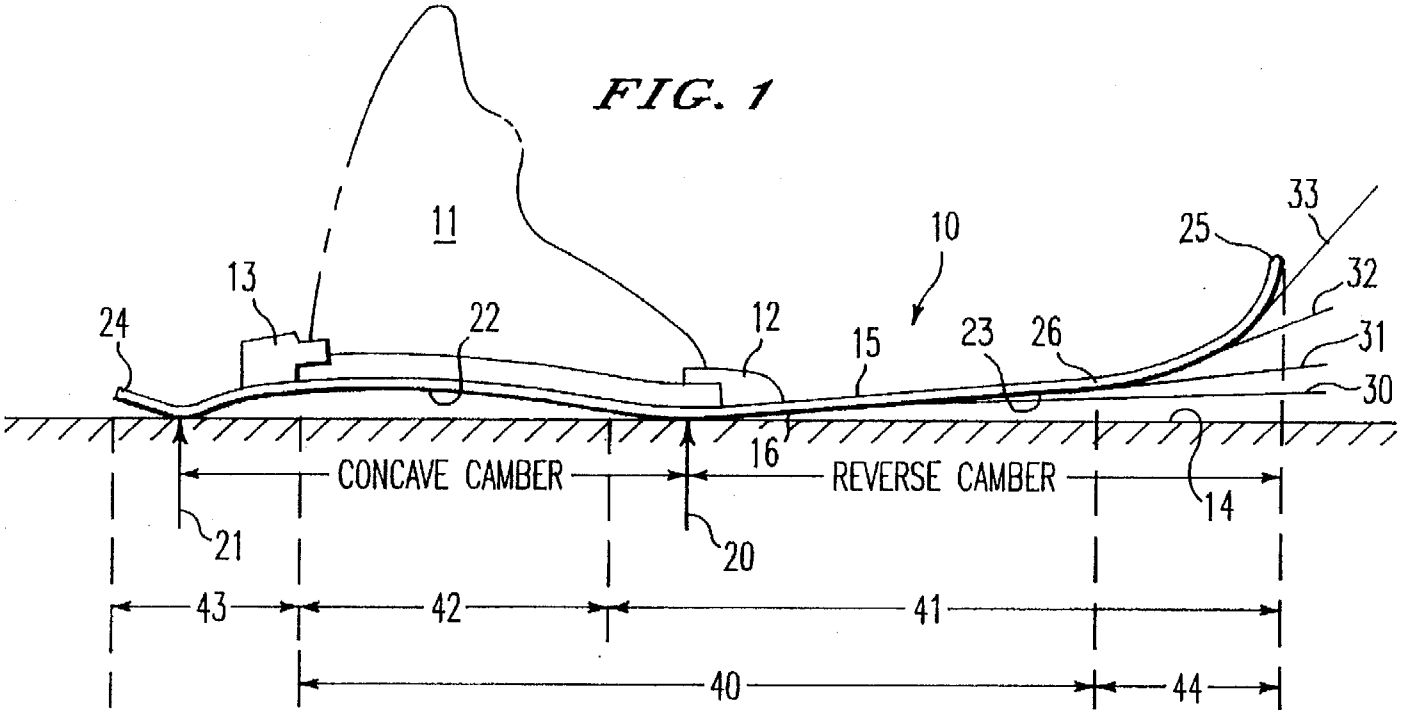
FIG. 1 sets forth a side elevation view of a ski constructed in accordance with the present invention.

FIG. 1 sets forth a ski constructed in accordance with the present invention and generally referenced by numeral 10. Ski 10 includes a top surface 15 and a bottom surface 16. A reference surface 14 is shown to illustrate the curvatures of ski 10. Ski 10 defines an upwardly curved concave camber portion 22 having a forward contact point 20 and a rear contact point 21 extending downwardly. An upwardly curved tail portion 24 extends rearwardly and upwardly from contact point 21. Ski 10 extends forwardly from contact point 20 in a reverse camber portion 23 which in accordance with the present invention defines an increasingly curved upwardly turned portion terminating in a tip portion 25. A plurality of tangent lines 30, 31, 32 and 33 are shown at positions progressively forward of contact point 20 to illustrate the increasing curvature of reverse camber portion 23.

A boot 11 constructed in accordance with conventional fabrication techniques is received upon top surface 15 and secured to ski 10 utilizing a pair of bindings 12 and 13 which may be also be fabricated in accordance with conventional fabrication techniques. In its preferred form, boot 11 is positioned with respect to front contact point 20 such that the ball of the skier's foot within boot 11 is generally overlying contact point 20.

In its preferred form, reverse camber portion 23 comprises approximately fifty percent of the length of ski 10. However, it will be apparent to those skilled in the art that the extent of reverse camber portion 23 may be varied to suit differing needs of the skier and different ski conditions without departing from the spirit and scope of the present invention. Ski 10 also defines different degrees of flexibility at different portions of the ski. Thus, the forward portion of ski 10 referenced by numeral 41 is preferably formed to be relatively flexible while the portion referenced by numeral 42 is preferably formed in a substantially rigid manner. Portion 43 extending rearwardly from portion 42 is preferably formed of a semi-flexible fabrication and thus is more flexible than rigid portion 42 but less flexible than flexible portion 41. In addition, ski 10 defines a weight bearing portion 40, a forwardly extending shovel portion 44 and a trailing portion 43. Weight bearing portion 40 extends generally from the heel of boot 11 forwardly to the point at which the curvature of reverse camber portion 23 begins increasing curvature at a substantially greater rate.

Figure 2:
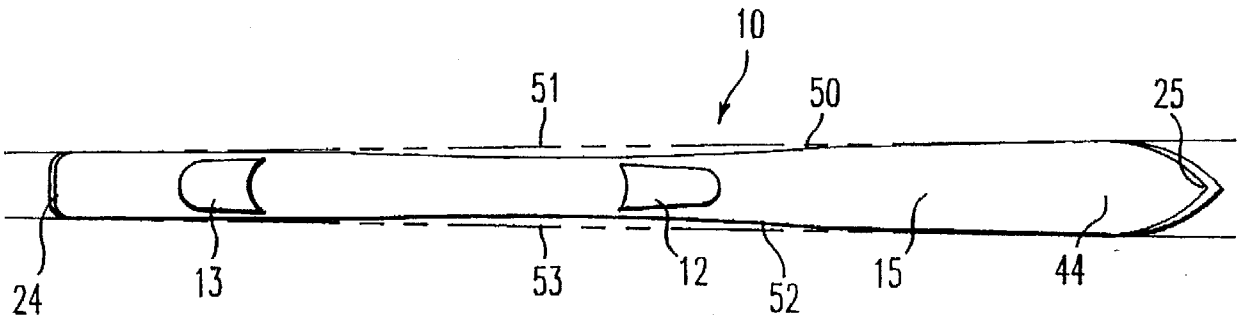
FIG. 2 sets forth a top plan view of a ski constructed in accordance with the present invention.

FIG. 2 sets forth a top view of ski 10 having boot 11 removed and having bindings 12 and 13 positioned upon top surface 15 for reference. Ski 10 defines a pair of symmetrically curved side edges 51 and 52 having the point of greatest inward extension or maximum "side cut" at points 51 and 53 respectively. As will be apparent from examination of FIG. 2, shovel portion 44 is substantially wider that tail portion 24 while the minimum widths at points 51 and 53 is generally proximate boot location portion between locations 12 and 13.

With reference to FIGS. 1 and 2, the present invention ski preferably defines a length between ninety and two hundred centimeters with the preferred length being approximately one hundred and ten centimeters for adults and approximately ninety centimeters and less for younger children. The "compound curved bottom" formed by concave camber portion 22 and the convex curved reverse camber portion 23 produces a front contact 20 and a rear contact point 21 and causes the present invention ski to form a general "S-shape". Boot 11 is preferably positioned such that the forward portion of boot 11 extends beyond front contact point 20 with the ball of the skier's foot being generally proximate and preferably overlying the front contact point.

In operation, rear contact point 21 resists turning and adds control and stability during straight line or nonturning skiing activities. Conversely, as the skier attempts to execute a turn, pressure upon front contact point 20 during the turn execution engages and flexes reverse camber portion 23 upwardly as pressure is applied to front contact point 20. Concurrently, as the skier leans into the slope, a turning action is produced. The skier very quickly finds that the turning operation is greatly enhanced by removing or shifting the skier's weight forwardly from contact point 21 to contact point 20 thereby relieving the resistance to turning and rotating upon contact point 20. This, in turn, further engages the convex or reverse camber portion 23 and configures the present invention ski to render turning easy and further encourages the skier to practice the preferred weight forward skiing technique. What makes this invention inherently easy is that all of this can be accomplished without speed because the forward portion of the invention is already reverse camber and ready to turn.

As is also seen in FIG. 1, the curvature of reverse camber portion 23 gradually increases (defining a reduced radius of curvature) from contact point 20 to tip 25 of shovel portion 44. This increased curvature is illustrated by the increasing angles of tangent lines 30 through 33 extending from bottom surface 16. This increase in curvature toward the forward tip of the present invention ski is in accordance with an important aspect of the present invention in that snow contact pressure against the bottom planar area of the ski in the direction forwardly from contact point 20 toward shovel portion 44 is gradually reduced. This degree of curvature change may be adjusted to suit the particular skier's needs and skill level. With reduced curvature change within reverse camber portion 23, enhanced snow contact is achieved and the ski becomes a faster responding ski. Conversely, by increasing the rate of curvature change within reverse camber portion 23, the ski becomes easier to turn and is therefore advantageous for the needs of the novice or relatively inexperienced skier. The curvature of reverse camber portion 23 may, under certain circumstances, include a concave portion provided that no additional contact point extending below contact point 20 is formed.

As mentioned above, the preferred position of boot 11 upon ski 10 is selected to generally align the ball of the skier's foot over front contact point 20. However, this position may be adjusted as needed. In its preferred form, front contact point 20 is determined by measuring the running surface which is measured from rear contact point 21 to point 26 which is located as the point at which the curvature of reverse camber portion 23 begins significant increase of curvature and dividing this running surface by two. It should also be noted that changes in responsiveness of this ski is also created by moving contact point 20 rearwardly toward tail portion 24.

As discussed above, one preferred position of boot 11 may be to align the ball of the skiers foot over the front contact point 20. However, as the user becomes a stronger skier, it may be preferable that the forward point of contact 20 be in the area of the toe of the ski boot as opposed to the ball-of-foot as in the beginner stages. Thus, and with reference to FIG. 1 of the present specification as one example, another possible embodiment is that the toe of the boot 11 will be over the front contact point 20. Such a configuration will reduce the tendency for the ski to make quick directional changes when speed and stability are the primary consideration. Ideally, the forward contact point 20 will not exceed 8 cm forward of the toe of the skiers boot. As discussed above, as one beneficial operation, and as is common for mounting practices, the skiers boot at its toe will partially cover or be just rearward of the center of the running surface of the ski (the running surface comprises the convex and concave portions of the ski and encompasses the entire convex section of conventional skis). Therefore, the forward contact point 20 on the ski will generally be developed approximate to the middle of the ski.

Furthermore, at no time should the convex aft portion exceed 75% of the running length of the skis's running surface, which would be a consideration in a shorter version of the skis of the present invention. In longer versions, the skiers boot would be improperly positioned forward of the center of the ski, thus violating common mounting practices and the effectiveness of the present invention.

Furthermore, some modifications to a side-cut may be performed that could add to the performance of the ski without detracting from the advantage of the present invention. As one example, the aft most tail portion may be the narrowest width of the ski, and yet a side-cut may, or may not, exist between this position and the forward widest point at the shovel section. This narrowing of the aft portion may create more resistance, as it has less snow contact area and therefore has more resistance to travel, and therefore has a stabilizing quality in assisting the ski to track more in a straight line, which may be very beneficial and which is typically unusual for a short ski as in the present invention.

Figure 3A:
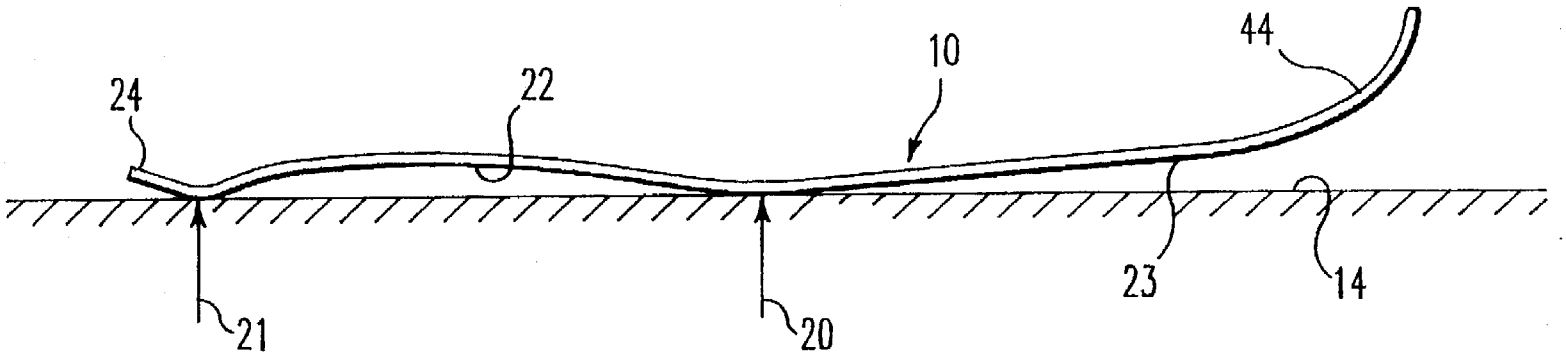
FIG. 3 sets forth a side profile view and weight distribution diagram of a ski constructed in accordance with the present invention.
Figure 3B:
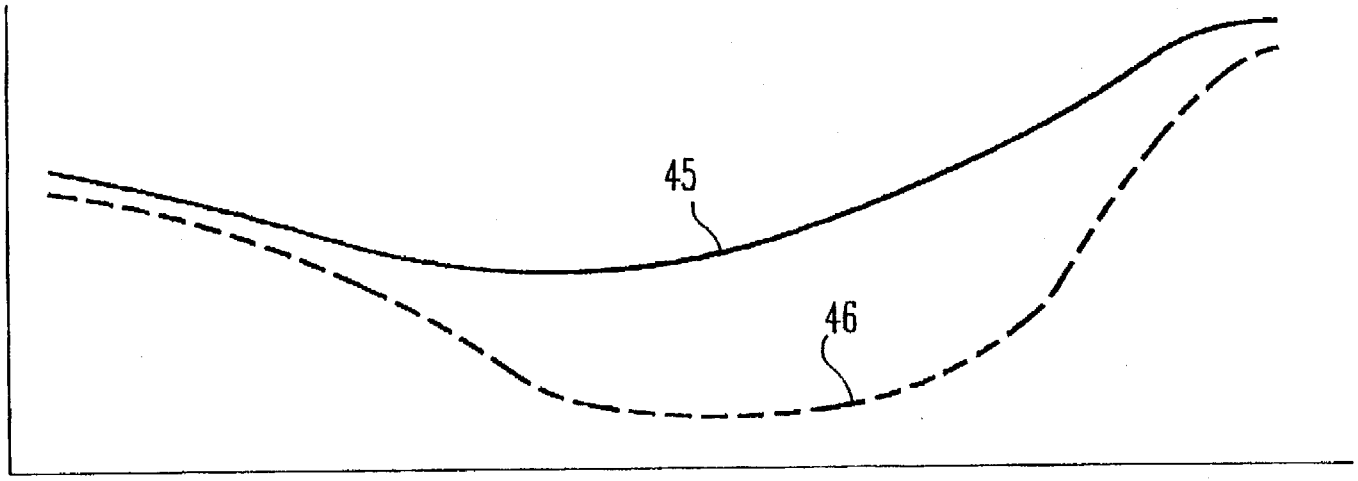

FIG. 3 sets forth a side profile view and weight distribution diagram of the present invention ski. As described above, ski 10 forms a compound curve undersurface defining a front contact point 20 and a rear contact point 21. Ski 10 also defines a concave camber portion 22, an upwardly curved tail portion 24 and a reverse camber portion 23 terminating in a shovel portion 44. Solid line 45 in FIG. 3 shows the weight distribution of the skier upon ski 10 under normal or nonturning circumstances. Thus, as can be seen, under normal circumstances, the skier's weight is generally evenly distributed upon ski 10 with a slight additional weight distributed to the rear portion of the ski. In contrast, dashed-line 46 of FIG. 3 sets forth the weight distribution of the skier during the above-described turning process in which the skier's weight has been shifted forward dramatically to provide flexing of reverse camber portion 23. As can be seen, the majority of the skier's weight has moved forwardly and away from rear contact point 21 and is generally supported by contact point 20 and reverse camber portion 23. This is in accordance with an important aspect of the present invention in which the skier is encouraged by the ski performance and response to move a weight forward condition during the turning process which frees up the tail portion of the ski and generally removes weight from rear contact point 21. The ski is, as a result, relatively easy to turn and the skier's performance is improved.

Figure 4A:
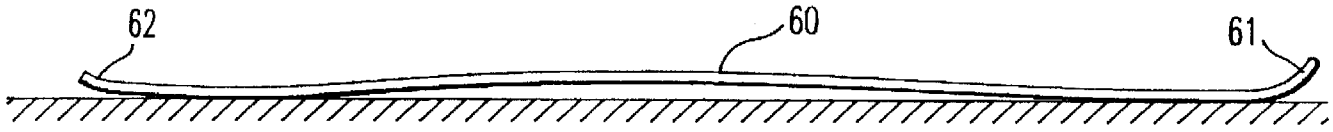
FIG. 4A PRIOR ART
FIG. 4 sets forth a side profile view and weight distribution diagram of a prior art conventional length ski.
Figure 4B:
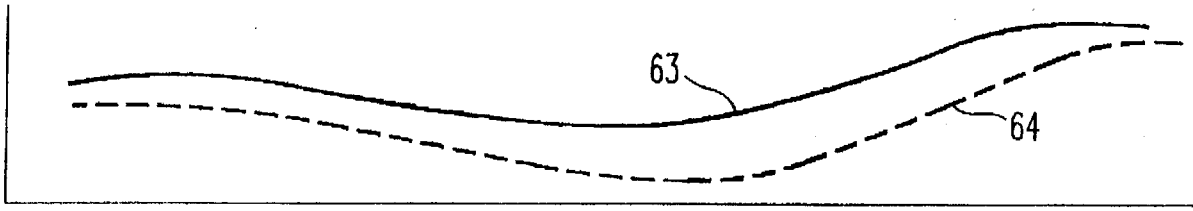
FIG. 4B PRIOR ART
Figure 5A:
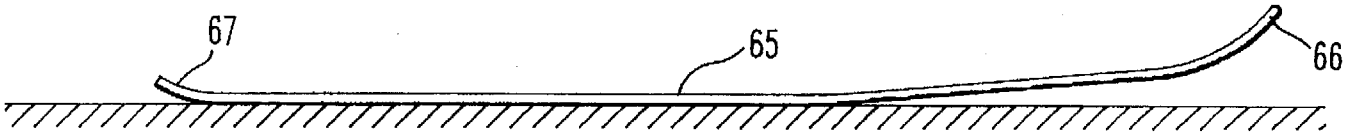
FIG. 5A PRIOR ART
FIG. 5 sets forth a side profile view and weight distribution diagram of a prior art short ski.
Figure 5B:
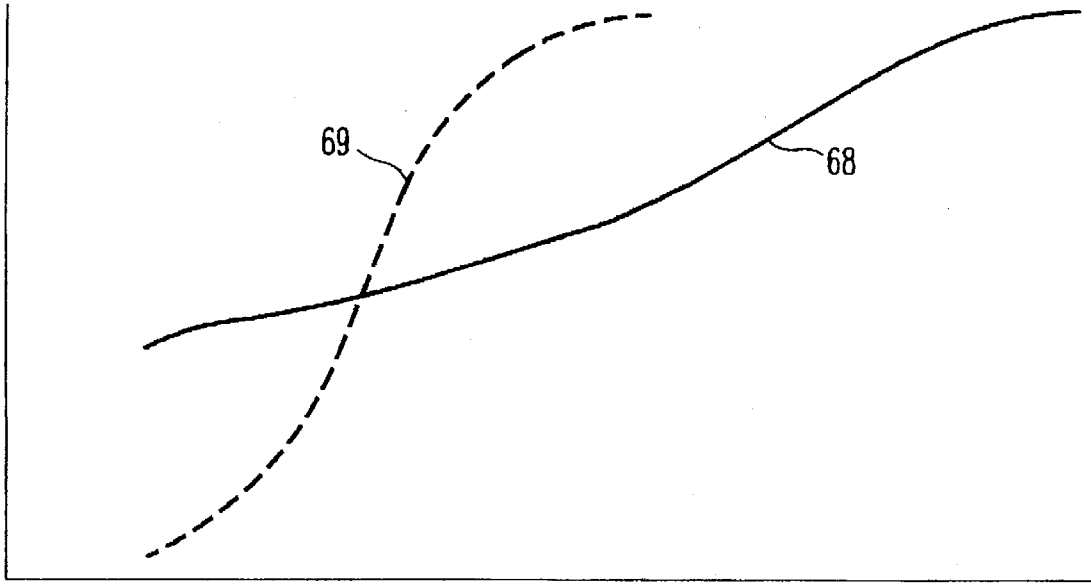
FIG. 5B PRIOR ART

FIGS. 4 and 5 set forth side profile views and weight distribution diagrams of prior art skis for use in comparison with the present invention ski. More specifically, FIG. 4 sets forth a conventional long ski having a center concave camber portion 60, a shovel 61 and a tail 62. Solid line 63 shows the weight distribution upon ski 60 in a nonturning operation while dashed-line curve 64 sets forth the weight distribution during the turning operation. As can be seen, the utilization of ski 60 results in a slight forward weight shift during the turning process, similar to that seen in weight distribution diagrams 45 and 46 of the present invention ski (shown in FIG. 3).

FIG. 5 sets forth a side profile view and weight distribution of a prior art "short ski" generally referenced by numeral 65 having a raised upwardly curved shovel portion 66 and a tail portion 67. Ski 65 is employed using a rearward weight shift in which the skier tends to sit back upon the rear portion of the ski. Solid line weight distribution curve 68 reflects this rear shifted weight distribution. Dashed line curve 69 shows the weight distribution resulting during the turning process when using ski 65. As can be seen, the turning process using ski 65 results in a dramatic rearward shift of the skier's weight. This type of ski makes it difficult for the skier to learn the preferable forward weight shift necessary to achieve increased skill on the part of the skier.

Figure 6:
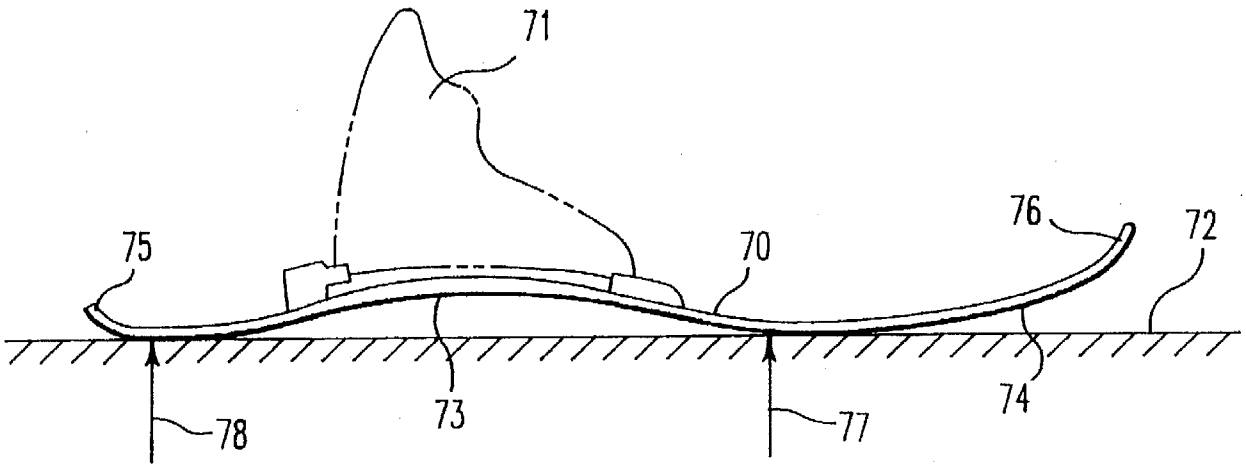
FIG. 6 sets forth a side elevation view of an alternate embodiment of the present invention ski.

FIG. 6 sets forth an alternate embodiment of the present invention ski generally referenced by numeral 70. Ski 70 is similar to ski 10 set forth and described above in that it defines a compound curve undersurface having a concave camber portion 73 and a reverse camber portion 74. Ski 70 is shown having a ski boot 71 secured thereto and is resting upon a surface 72. Ski 70 further defines an upwardly curved shovel portion 76 and an upwardly curved tail portion 75. A front contact point 77 is formed at the transition of concave camber 73 and reverse camber 74. A rear contact point 78 is formed at the transition of concave camber portion 73 and upwardly curved tail portion 75.

Ski 70 differs from ski 10 set forth and described above in that reverse camber portion 74 is substantially reduced in length while concave camber portion 73 is substantially increased in length. Thus, reversed camber portion 74 forms approximately twenty-five percent of the overall length of ski 70. In addition, boot 71 is secured to the upper surface of ski 70 at a position which may be varied from the generally centered upon concave camber portion 73 shown in FIG. 6 to a more forward position such as that set forth in FIG. 1.

The embodiment of the present invention ski set forth in FIG. 6 is intended primarily to meet the needs of more advanced and more highly skilled skiers. The embodiment of FIG. 6 requires greater speed and pressure or weight shifting to manipulate this ski. In addition, the embodiment of FIG. 6 is more advantageously configured for skiing in so-called powder snow in that the position of ski boot 71 with respect to front contact point 77 precludes the tendency of the ski tips to drop down into such powder snow. Thus, comparison of FIG. 6 with ski 10 shown in FIG. 1 provides some measure of the degree of adaptability of the present invention ski to different ski conditions and different skier skill levels.

Figure 7:
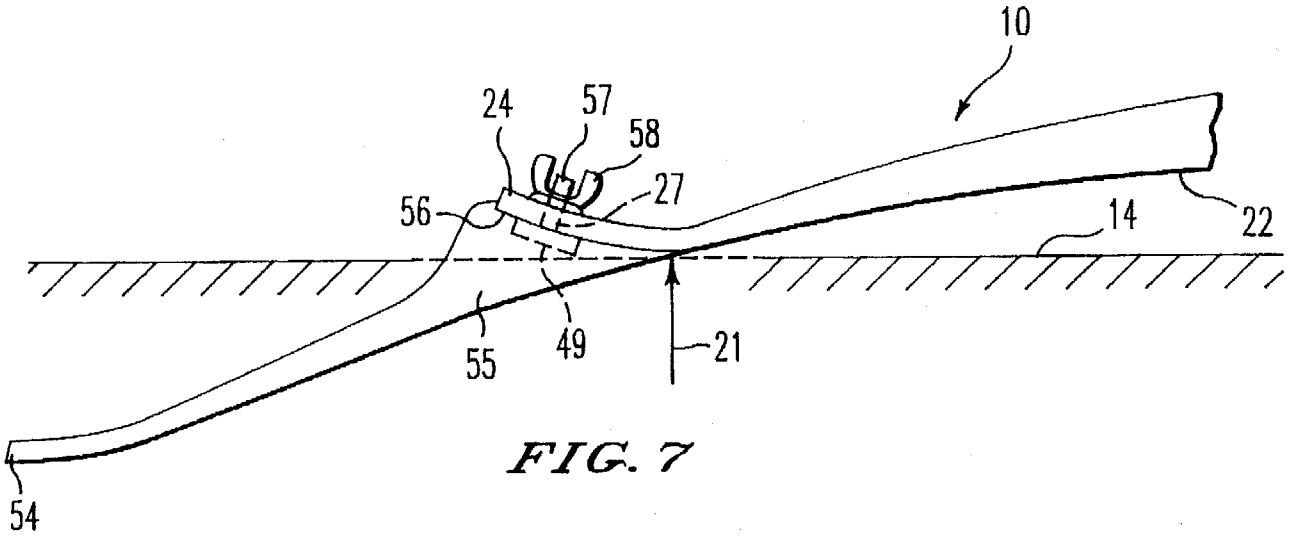
FIG. 7 sets forth a partial section view of the present invention ski having a tail extension secured thereto.

FIG. 7 sets forth a still further alternate embodiment of the present invention in which a tail extension generally referenced by numeral 55 has been added to tail portion 24 of ski 10. Tail extension 55 defines a generally planar undersurface 59 which continues and extends the existing planar bottom surface 22 of ski 10 and an extending tail portion 54. Tail extension 55 further defines a locating edge 56 and supports a plurality of upwardly extending fasteners such as fastener 57. Correspondingly, tail portion 24 of ski 10 defines a plurality of apertures such as aperture 27 which receive the upwardly extending fasteners of tail extension 55. A conventional securing fastener such as a wing nut or the like 58 is received upon and secured to each of the fasteners extending upwardly from tail extension 55.

The operational benefit of tail extension 55 is the provision of additional ski length to increase the skier's speed and flotation. Thus, the effective length of the present invention ski can be increased by tail extension 55.

What has been shown is an improved ski having a compound curve undersurface which defines a concave camber portion and a reverse camber convex portion to provide contact points ahead of and behind the ski boot secured to the upper surface of the ski. The use of a reverse camber flexible portion of the ski extending forwardly from the ski boot produces a favorable response during turning when the skier employs a forward weight shift freeing upon the rear contact point. This, in turn, encourages appropriate weight shifting habit patterns for the novice or learning skier and provides substantially improved confidence and performance leading to more easy achievement of advanced skiing techniques. The present invention ski is preferably substantially shorter than conventional skis and permits the user to exercise control by weightshifting to the rear contact point as well as enhanced turning capability by weightshifting forwardly.

Figure 8:
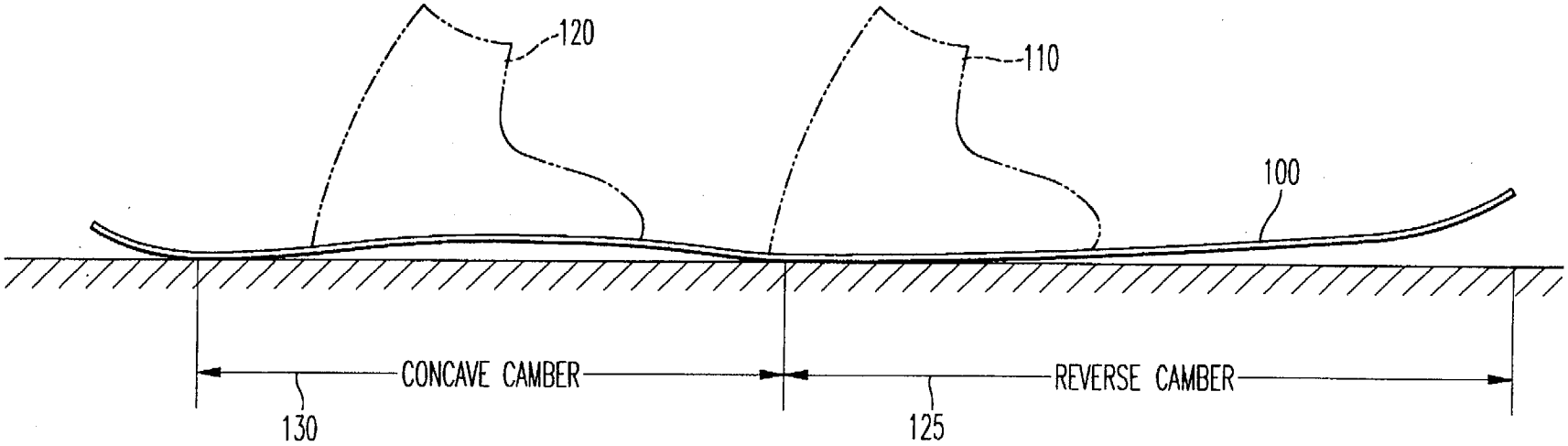
FIG. 8 sets forth a further embodiment of the present invention directed to a snowboard or a mono-ski.

FIG. 8 of the present specification shows a further embodiment of the present invention. In this further embodiment of FIG. 8 is shown the application of the present invention to a snowboard, snowboard ski or mono-ski. As shown in FIG. 8 of the present specification, the snowboard of the present invention will have a board surface 100, on which are formed two boots 110, 120. According to the present invention, the snowboard 100 contains a first contact point 125 where the snowboard 100 contacts the snow and a second contact point 130, which is a rear contact point, which also contacts the snow. In applying the principles of the present invention to that of a snowboard, the same inherent benefits of ease of learning exists for a novice snowboarder as for a novice snow skier. The system of the present invention when applied to a snowboard provides significant advantages as snowboards are inherently difficult for beginners.

Conventionally, snowboards, like snow skis, have convex camber portions throughout their entire length. Snowboards have conventionally two shoe locations mounted fore and aft and generally both ends of a snowboard are turned up so that a snowboard can be used going either forward or backward. The snowboard is then maneuvered by lifting up on the aft shoe 120 by repositioning it in a desired direction of travel while the forward shoe 110 becomes the weight-bearing portion during such a maneuver.

Unlike the conventional snowboard, the snowboard of the present invention provides a structure of a "compound camber", featuring a "concave camber portion" and a "reverse camber portion", which is designed to cause the snowboard to travel primarily in a forward direction. Similarly to conventional snowboards, the snowboard of the present invention has two shoe locations for boots 110, 120 which are respectively fore and aft so that the aft shoe 120 straddles the aft concave camber portion and the forward shoe 110 may be developed over the reverse camber forward position.

According to the present invention, the effectiveness of the forward contact point 125 and the rear contact point 130 is aggressively utilized by a snowboarder as he or she alternates his or her weight from one boot to the other. In the present invention, more weight on the rear boot 120 located aft of the forward contact point 125 engages the rear contact point 130 more effectively, while weight forward onto the forward boot 110 engages the forward contact point 125 for enhanced maneuverability. The utilization of the reverse cambered portion of the present invention allows for enhanced turning at very low speeds, which is a very desirable feature for new snowboarders, but it also allows the advanced skier to contrarily use the rear shoe 120 to remain as a weight-bearing section in effecting a turn as the forward shoe 110 has the ability to utilize the reverse camber portion to take on a more directional steering function and thus allowing the user to be always driving in turns. Such a principle is used in water skiing, but due to the shape of conventional snowboards such a principle has not been available to the snowboarder until now.

Also, under most circumstances the aft shoe 120 will not at all cover the first contact point 125. Further, in preferable embodiments, the forward shoe 110 can be located in such a manner that a portion of it could cover the forward contact point 125. The forward point of contact 125 can extend forward allowing the concave camber portion to cover 75% of the running surface of the snowboard 100. The dimensions of the snowboard of the present invention are generally the same as for snowboards common in the industry, contrary to the ski of the present invention which will generally have a much shorter length.

As discussed above, the present invention can also be applied to a mono-ski. If the mono-ski features two boots located side-by-side, a positioning of the boots as discussed above relative to the ski of FIGS. 1–7 can be utilized. If the mono-ski features two boots placed fore and aft, positioning of the boots as in the snowboard of FIG. 8 can be implemented. Such mono-skis would achieve the same benefits as discussed above with respect to both beginner and advanced skiers.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A snow ski for use by a skier on a snow covered surface having a tip portion, a rear end portion, and a lower running surface, comprising:

a first contact area of the lower running surface where the ski contacts the snow covered surface;

a second contact area of the lower running surface proximate the rear end portion where the ski contacts the snow covered surface;

a concave camber portion of the lower running surface which extends upwardly from the snow covered surface and is formed between the first and second contact areas;

a reverse camber convex portion extending forwardly from the first contact area to the tip portion of the ski; and a boot mounting area extending so as to be formed above the first contact area, wherein the boot mounting area is positioned so that a toe area of a foot of the skier placed in a boot in the boot mounting area is positioned above the first contact area.

2. The snow ski according to claim 1, wherein said concave camber portion has a greater rigidity than said reverse camber convex portion.

3. The snow ski according to claim 1, wherein said reverse camber convex portion defines a radius of curvature which decreases from a maximum at said first contact area to a minimum at the tip portion of the ski.

4. The snow ski according to claim 1, wherein said ski further comprises straight side edges.

5. The snow ski according to claim 1, wherein said ski further comprises inwardly curved side edges.

6. The snow ski according to claim 5, wherein said inwardly curved side edges form a minimum ski body width at said boot mounting area.

7. The snow ski according to claim 5, wherein said inwardly curved side edges form a minimum ski body width at the rear end portion.

8. The snow ski according to claim 5, wherein said inwardly curved side edges form a minimum ski body width at a tail portion of the ski.

9. The snow ski according to claim 1, further comprising a binding mounted in the boot mounting area for securing the boot to the ski.

10. The snow ski according to claim 1, further comprising:

a tail extension secured to the rear end portion of the ski so that a bottom surface of the tail extension is aligned with a lower surface of the ski.

11. A snow ski for use by a skier on a snow covered surface having a tip portion, a rear end portion, and a lower running surface, comprising:

a first contact area of the lower running surface where the ski contacts the snow covered surface;

a second contact area of the lower running surface proximate the rear end portion where the ski contacts the snow covered surface;

a concave camber portion of the lower running surface which extends upwardly from the snow covered surface and is formed between the first and second contact areas;

a reverse camber convex portion extending forwardly from the first contact area to the tip portion of the ski; and a boot mounting area, wherein the boot mounting area is positioned so that a toe area of a foot of the skier placed in a boot in the boot mounting area is positioned not more than 8 cm behind the first contact area.

* * * * *